US010578305B2

(12) United States Patent
Deiss et al.

(10) Patent No.: US 10,578,305 B2
(45) Date of Patent: Mar. 3, 2020

(54) BRUNER ASSEMBLY

(71) Applicant: Siemens Aktiengesellschaft, Munich (DE)

(72) Inventors: Olga Deiss, Düsseldorf (DE); Thomas Grieb, Krefeld (DE); Patrick Lapp, Berlin (DE); Jens Kleinfeld, Mülheim an der Ruhr (DE); Matthias Chlebowski, Mülheim a. d. Ruhr (DE); Fabian Sander, Mülheim (DE); Christian Beck, Essen (DE); Andreas Böttcher, Mettmann (DE); Patrick Ronald Flohr, Mülheim a.d. Ruhr (DE); Thomas Hauser, Strausberg (DE); Simon Purschke, Berlin (DE); Günther Walz, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 360 days.

(21) Appl. No.: 15/514,773

(22) PCT Filed: Oct. 29, 2015

(86) PCT No.: PCT/EP2015/075053
§ 371 (c)(1),
(2) Date: Mar. 27, 2017

(87) PCT Pub. No.: WO2016/071186
PCT Pub. Date: May 12, 2016

(65) Prior Publication Data

US 2017/0227223 A1 Aug. 10, 2017

(30) Foreign Application Priority Data

Nov. 3, 2014 (DE) ..... 10 2014 222 402

(51) Int. Cl.
*F23R 3/28* (2006.01)
*F23R 3/10* (2006.01)

(52) U.S. Cl.
CPC ..... *F23R 3/283* (2013.01); *F23R 3/10* (2013.01); *F23R 3/286* (2013.01); *F23R 2900/03043* (2013.01)

(58) Field of Classification Search
CPC ..... F23R 3/283; F23R 3/286; F23R 2900/03041; F23R 2900/03042;
(Continued)

(56) References Cited

U.S. PATENT DOCUMENTS 4,100,733 A 7/1978 Striebel et al.
5,357,745 A 10/1994 Probert
(Continued)

FOREIGN PATENT DOCUMENTS

CH 707843 A2 9/2014
CN 101008327 A 8/2007
(Continued)

OTHER PUBLICATIONS

Russian Federation decision to grant dated Mar. 20, 2018, for RU patent application No. 2017119002.
(Continued)

*Primary Examiner* — Carlos A Rivera
(74) *Attorney, Agent, or Firm* — Beusse Wolter Sanks & Maire

(57) ABSTRACT

A burner assembly with a combustion chamber, a plurality of mixing ducts leading into the combustion chamber, where combustion air and introduced fuel are mixed. The mixing ducts are formed by mixing tubes extending axially through an annular space between a tubular outer wall, a tubular inner wall arranged radially at a distance from the outer wall, a ring-shaped end plate arranged upstream and a ring-shaped
(Continued)

end plate arranged downstream. The end plates have through-openings, which accommodate and/or extend the mixing tubes, and the end plates have, both radially inside and outside, a circumferential edge extending in the direction of the annular space, with axial bores in the edge of the ring-shaped end plate arranged downstream. The axial bores extend from the annual space into the end plate, and at least one opening is for removing cooling air, the opening branching from the axial bore.

12 Claims, 6 Drawing Sheets

(58) Field of Classification Search
CPC ..... F23D 14/62; F23D 14/64; F23D 11/40; F02C 7/222
See application file for complete search history.

(56) References Cited

U.S. PATENT DOCUMENTS

| | | | |
|---|---|---|---|
| 5,377,483 | A | 1/1995 | Mowill |
| 2007/0177975 | A1 | 8/2007 | Luczak et al. |
| 2009/0188255 | A1 | 7/2009 | Green et al. |
| 2010/0236248 | A1 | 9/2010 | Karthick et al. |
| 2010/0300106 | A1 | 12/2010 | Edwards et al. |
| 2012/0031098 | A1 | 2/2012 | Leonid et al. |
| 2013/0029277 | A1 | 1/2013 | Koizumi et al. |
| 2013/0300430 | A1 | 11/2013 | Lindsay et al. |
| 2014/0083110 | A1* | 3/2014 | Stewart ..... F23R 3/283 60/776 |
| 2014/0202163 | A1* | 7/2014 | Johnson ..... F02C 7/00 60/752 |
| 2014/0338344 | A1 | 11/2014 | Stewart et al. |
| 2015/0285502 | A1* | 10/2015 | DiCintio ..... F23R 3/283 60/737 |
| 2016/0054004 | A1* | 2/2016 | Stoia ..... F02C 7/18 60/806 |
| 2017/0089583 | A1* | 3/2017 | Simmons ..... F23R 3/286 |

FOREIGN PATENT DOCUMENTS

| | | |
|---|---|---|
| CN | 101206029 A | 6/2008 |
| CN | 101839486 A | 9/2010 |
| CN | 102345880 A | 2/2012 |
| EA | 201101133 A1 | 3/2013 |

OTHER PUBLICATIONS

DE Search Report dated Jul. 29, 2015, for DE application No. 102014222402.0.
International Search Report dated Feb. 5, 2016, for PCT application No. PCT/EP2015/075053.
CN search report dated Jul. 18, 2018, for CN patent application No. 2015800296484.

* cited by examiner

BRUNER ASSEMBLY

CROSS REFERENCE TO RELATED APPLICATIONS

This application is the US National Stage of International Application No. PCT/EP2015/075053 filed Oct. 29, 2015, and claims the benefit thereof. The International Application claims the benefit of German Application No. DE 102014222402.0 filed Nov. 3, 2014. All of the applications are incorporated by reference herein in their entirety.

FIELD OF INVENTION

The invention relates to a burner assembly, in particular for a gas turbine.

BACKGROUND OF INVENTION

As gas turbines have developed, so have the turbine inlet temperatures continued to increase in order to achieve increased output and greater efficiency. Corresponding burners must, inter alia, be provided for this purpose.

These burners are also required to meet the strictest requirements in terms of manufacturing and servicing, as a result of which there are, inter alia, also strict requirements in terms of useful life. In particular components that are exposed to high temperatures or temperature gradients such as for example that end plate of a burner which faces the combustion chamber, experience high local stresses during operation, which result, inter alia, in the peeling of ceramic coatings and hence in premature component failure.

SUMMARY OF INVENTION

An object of the invention is to develop said device such that a long component life is ensured even when there are strict requirements in terms of temperature and temperature gradients.

The invention achieves this object by providing that, in such a burner assembly with a combustion chamber, multiple mixing ducts opening into the combustion chamber and in which during normal operation introduced combustion air and introduced fuel are mixed, wherein the mixing ducts are formed by mixing tubes which extend axially through an annular space which is defined between a tubular external wall, a tubular internal wall arranged so that is spaced apart radially from the external wall, an annular end plate arranged upstream, and an annular end plate arranged downstream, wherein the end plates are provided with through openings which receive and/or continue the mixing tubes and have, both radially inward and radially outward, a circumferential edge which extends in the direction of the annular space, axial bores are provided in the edge of the annular end plate arranged downstream which extend essentially parallel to a perpendicular to the end plate, away from the annular space and into the end plate, and that at least one opening branching off from the axial bore is provided for the removal of cooling air.

As a result, cooling air can be transported simply into thermally stressed regions of the burner in order to reduce the temperature there during operation or to ensure a more homogeneous temperature distribution. This measure reduces temperature-induced stresses in the material and extends the useful life of the component.

In an advantageous embodiment, the at least one opening opens into a chamber or a cooling air pocket which is open toward the annular space. As a consequence of these chambers or cooling air pockets, the accumulation of material in the region close to the combustion chamber is reduced. Moreover, a more homogeneous temperature distribution results. The temperature-induced stresses can thus be significantly reduced.

Multiple bores advantageously open into the chamber or cooling air pocket. The cooling effect in the chamber or the cooling air pocket can thus be maximized.

The highest thermal stresses are typically found in the end plate in its radially outer and radially inner edge. It is therefore advantageous if bores are arranged in these regions.

In a further advantageous embodiment of the invention, the opening opens into an elongated depression which extends from the combustion chamber upstream in the edge of the end plate. By introducing relieving slits into thermally stressed regions, this component is made more flexible at highly stressed points and can thus react better to thermal expansion without the stress values becoming too high. It is therefore particularly advantageous if the depression is arranged radially inward in the inner edge because the stress values of the component are highest there. Flushing with air from the bores serves to prevent dead areas in the depression in which the hot air remains.

So that the end plate also seals off the combustion chamber, it is expedient if the length of the depression is less than the height of the edge.

It is moreover advisable, with regard to the fact that stresses in the material are intended to be reduced by these measures, if the base of the depression has a cross-sectional profile which is a circle, an oval, or an ellipse so that sources of elevated material stresses, such as for example edges, are avoided.

The openings of two bores advantageously open into a depression in such a way that opposite sides of the depression can be cooled by impingement cooling.

Lastly, it is advantageous if further openings are arranged in the depression in the direction of the annular space. The further openings can be used as resonator openings. The number of resonator bores which may already be present on the burner-side end plate can be reduced by these additional resonators, as a result of which the spacing between the resonator bores is enlarged and hence the stresses between the resonator bores are reduced.

End plates of this type can be produced using electrochemical machining (ECM), electrical discharge machining (EDM) and selective laser melting (SLM).

The embodiments of the invention mentioned, both individually and in combination, result in a reduction of stress peaks and hence in an increased useful life of the end plate. As a result of the cooling using cooling air at the points where there is a high temperature load, the end plate heats up more uniformly during transient processes, and also in stationary mode there is a more homogeneous temperature distribution. This causes lower temperature loads at identical thermal conditions. They thus enable a significant extension of the useful life of the end plate with identical thermal edge conditions. The control region during operation is thus enlarged and more cost-effective alternatives result in terms of materials and coatings.

BRIEF DESCRIPTION OF THE DRAWINGS

The invention is explained in detail by way of example with the aid of the drawings in which, schematically and not to scale.

DETAILED DESCRIPTION OF INVENTION

Figure 1:
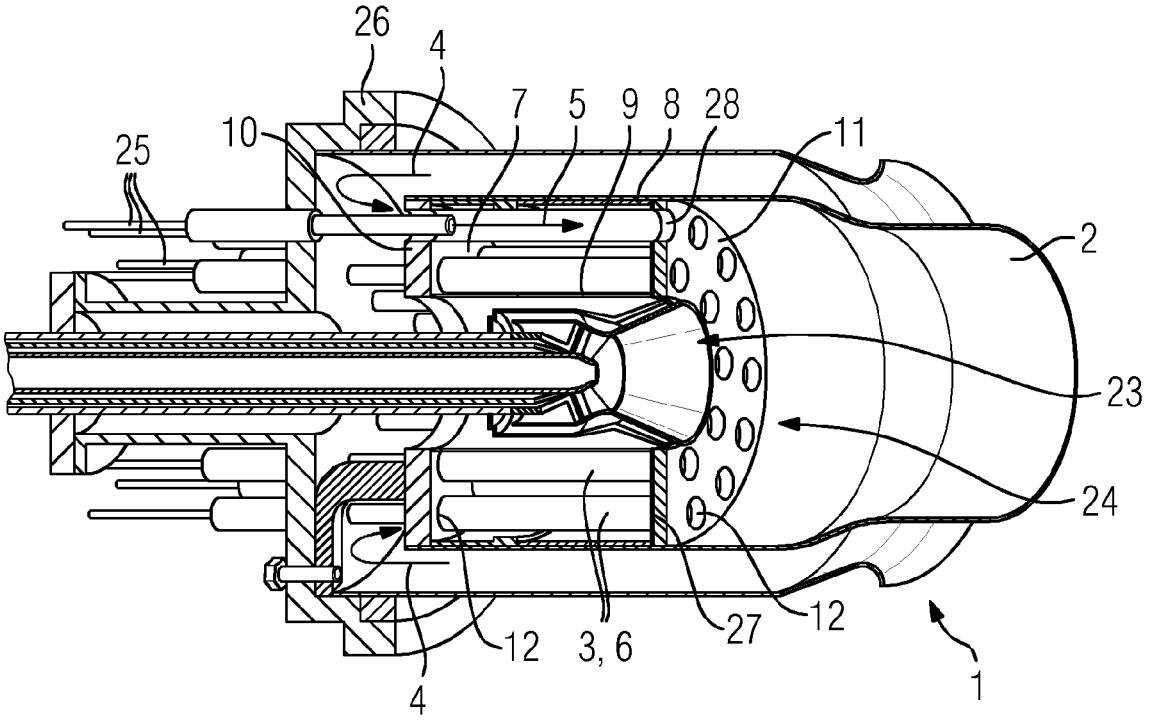
FIG. 1 shows a schematic view in section of a burner assembly.

The drawings show a burner assembly 1 according to an embodiment of the present invention or components thereof. The burner assembly 1 in FIG. 1 comprises a combustion chamber 2, a centrally arranged pilot burner 23, a mixing tube assembly 24 with multiple mixing tubes 6 which form mixing ducts 3 which open into the combustion chamber 2, multiple fuel injectors 25 which project into the mixing tubes 6 as far as a suitable position, and a mounting plate 26 which receives the mixing assembly 24 and serves to fasten the burner assembly 1 to a machine housing (not shown in detail).

The mixing tube assembly 24 comprises a tubular external wall 8, a tubular internal wall 9 arranged so that it is spaced apart radially from the external wall 8, an annular end plate 10 arranged upstream and an end plate 11 arranged downstream which define an annular space 7 through which the mixing tubes 6 extend axially. The end plate 11 has a circumferential edge 13, 14 which extends in the direction of the annular space 7 both radially inward and radially outward. The mixing tube assembly 24 moreover comprises an annular dividing plate 27.

The end plate 10 arranged upstream comprises multiple through openings 12 which receive and/or continue the mixing tubes 6. In the present case, the through openings 12 define two circular holes with circular hole diameters which differ from one another, wherein the through openings 12 of the first circular hole and the through openings 12 of the second circular hole are arranged so that they are offset radially relative to one another. The end plate 10 moreover has multiple air ducts (not shown in FIG. 1) which extend axially and are arranged distributed over the annular surface of the end plate 10.

In a similar manner to the end plate 10, the dividing plate 27 is provided with through openings 28 which are aligned axially with the through openings 12 of the end plate 10. The dividing plate 27 is moreover provided with multiple flushing air ducts 29 which are arranged distributed over the annular surface of the dividing plate 27.

In a similar manner to the end plate 10 and the dividing plate 27, the end plate 11 arranged downstream comprises through openings 12 which are aligned axially with the through openings 12 of the end plate 10 and the through openings 28 of the dividing plate 27. Air ducts 30 which extend axially are moreover formed in the end plate 11 and fluidically connect the annular space 7 to the combustion chamber 2.

During operation, a fuel 5 and combustion air 4 flow through the blast nozzles, i.e. the mixing tubes 6, and pass into the combustion chamber 2 as a fuel/air mixture.

Figure 2:
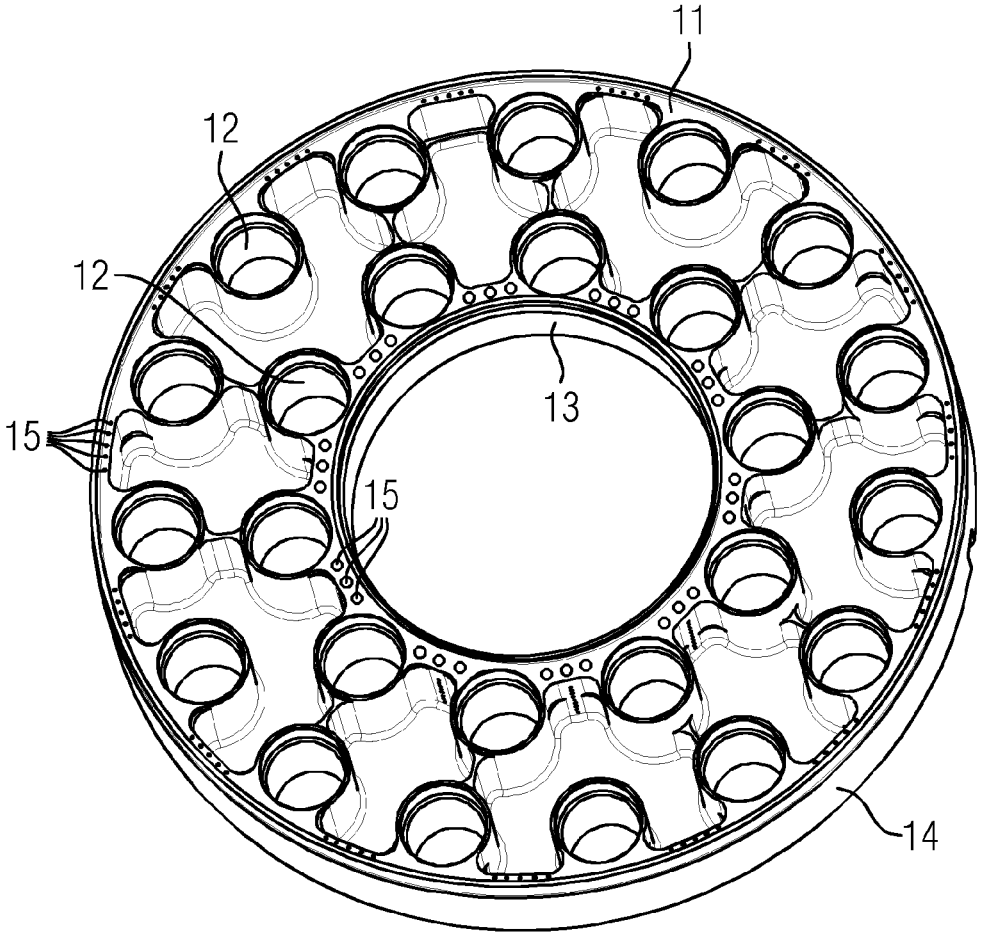
FIG. 2 shows an end plate with axial bores in the edge.

FIG. 2 shows the tubular end plate 11 arranged downstream with through openings 12 and axial bores 15 in the edge 13, 14 both radially inward and radially outward. The bores 15 extend essentially parallel to a perpendicular to the end plate 11 from the annular space 7 into the end plate 11.

Figure 3:
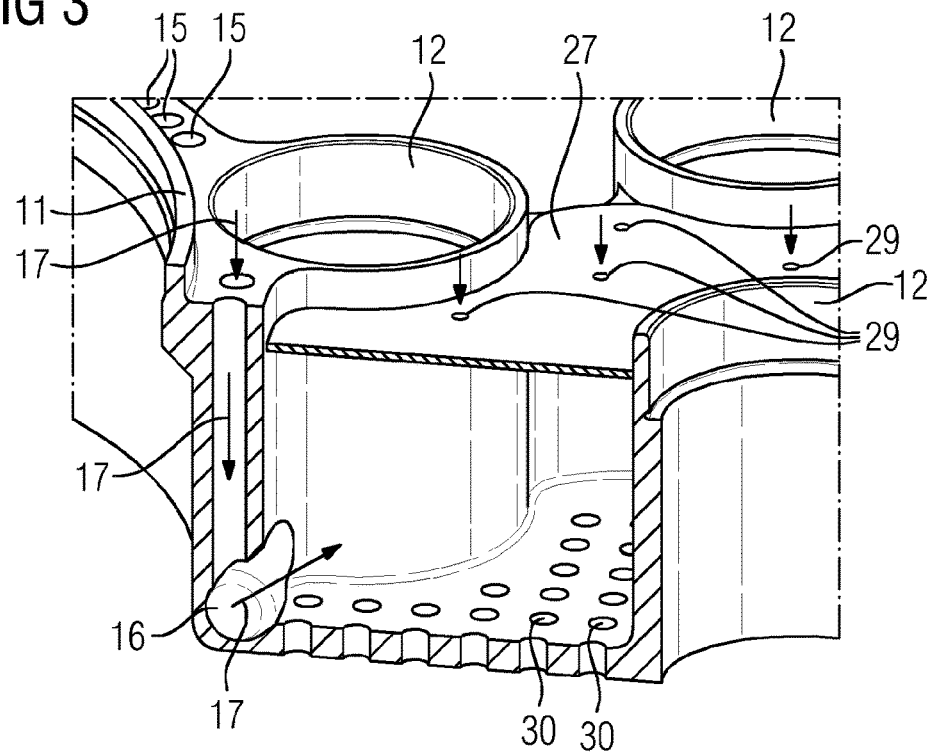
FIG. 3 shows a detailed view of the end plate.

It can be seen in FIG. 3 that at least one opening 16, branching off from the axial bore 15, is provided to remove cooling air 17.

Figure 4:
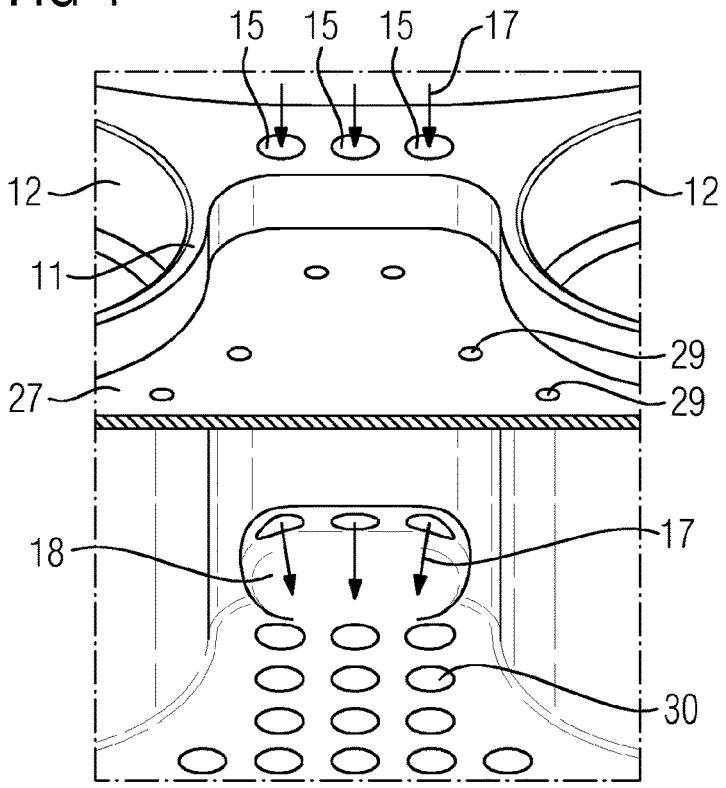
FIG. 4 shows a further detailed view of the end plate.
Figure 5:
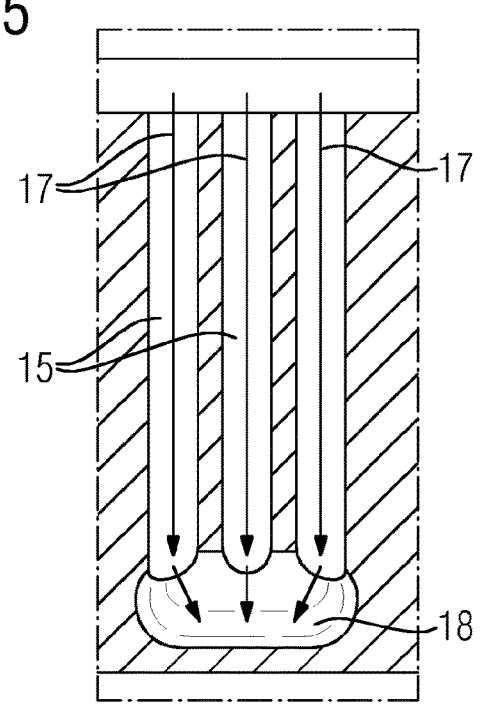
FIG. 5 shows a view in section of the bores in the end plate.

It can be seen in FIG. 4 how multiple bores 15 open into the chamber 18. FIG. 5 also shows the same thing from a different angle and in cross-section. The chambers 18 or also cooling air pockets can consist of a combination of bores and milled portions or be produced using other manufacturing methods. In particular the positioning at the points of high temperature on the inner cylindrical surface and the outer cylindrical surface of the end plate result in better temperature distribution and thus lower temperature-induced stresses.

Figure 6:
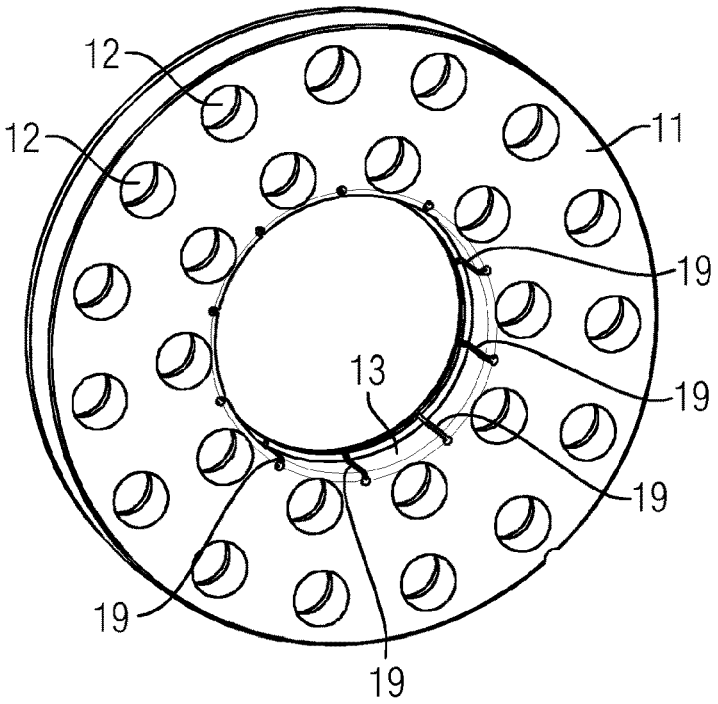
FIG. 6 shows an end plate with elongated depressions.

FIG. 6 shows an embodiment of the invention with elongated depressions 19 which extend from the combustion chamber 2 upstream in the edge 13 of the end plate 11. The depressions are arranged radially inward in the inner edge 13. Its length is less than the height of the edge 13.

Figure 7:
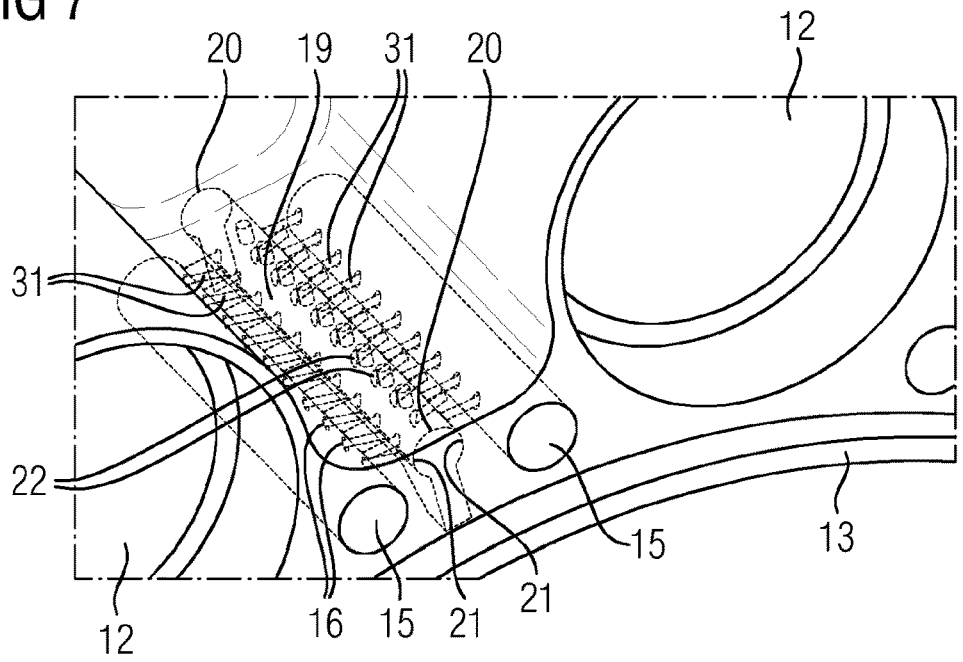
FIG. 7 shows a view of the inner structures of an end plate.

The structures inside the edge 13 of the end plate 11 are shown in FIG. 7. In the exemplary embodiment, in each case two bores 15 are associated with a depression 19. The bores 15 have openings 16 for removal of cooling air 17. This cooling air 17 flows through ducts 31 to the depression 19. The openings 16 or the ducts 31 are arranged in such a way that opposite sides 21 of the depression 19 can be cooled by impingement cooling. FIG. 7 also shows that the base 20 of the depression 19 has a cross-sectional profile which is a circle, an oval, or an ellipsis. It can moreover be seen in FIG. 7 that further openings 22 are arranged in the depression 19 in the direction of the annular space 7.

Figure 8:
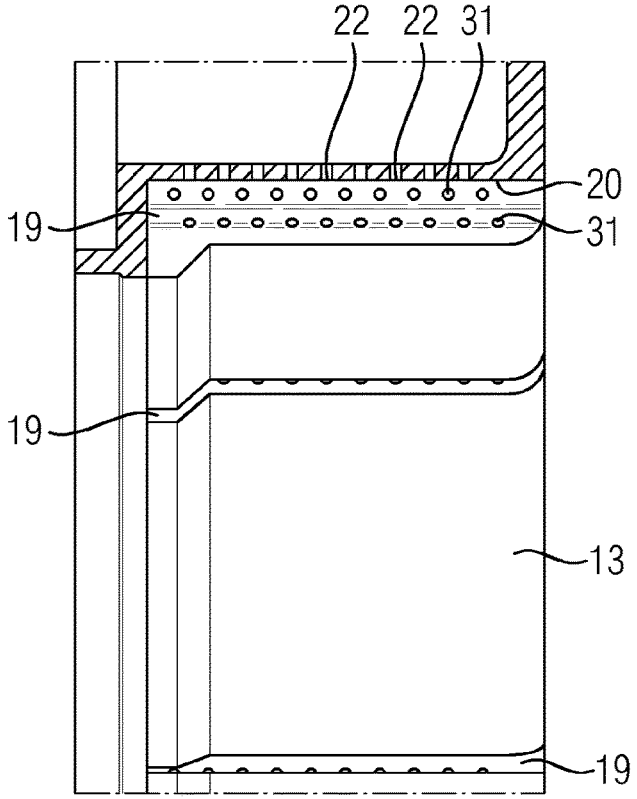
FIG. 8 shows a view in section of the elongated depression.

FIG. 8 shows a view of the same exemplary embodiment with a cross-section through a depression 19. Visible here are the round base 20 of the depression 19, and the ducts 31 which, coming from the openings 16 of the bores 15, open into the depression 19, and further openings 22 which, starting from the depressions 19, open into the annular space 7.

Figure 9:
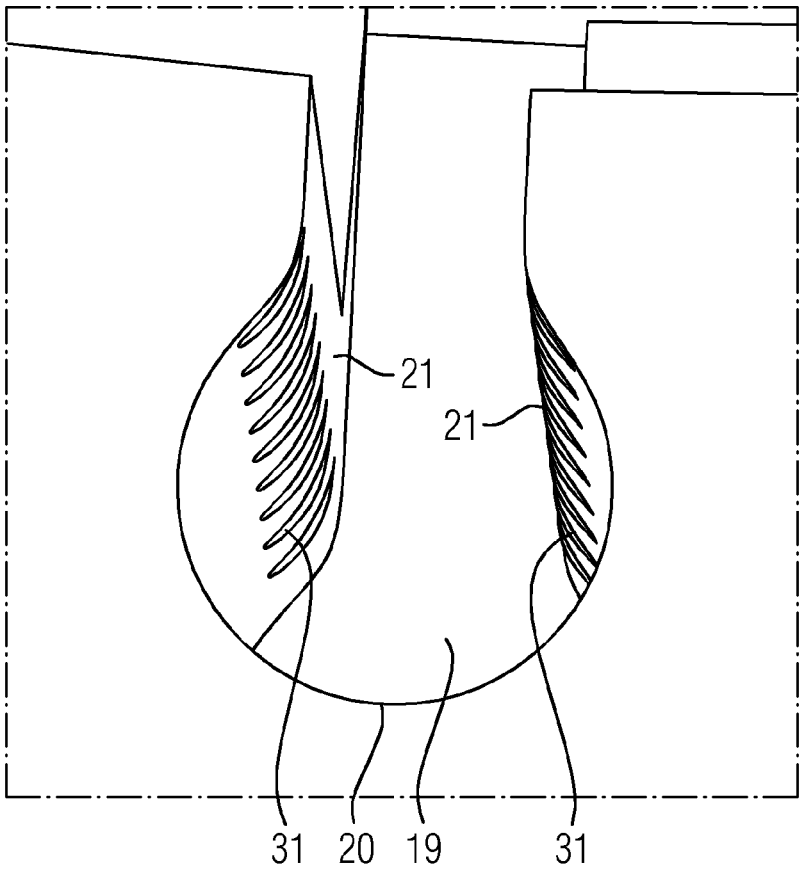
FIG. 9 shows a view along the axis of the depression.

FIG. 9 shows the view, from the combustion chamber side, of the edge 13 into a depression along its longitudinal axis. The outlets of the ducts 31 can be seen.

Although the invention has been illustrated and described in detail by the preferred exemplary embodiment, the invention is not limited by the disclosed examples and other variants can be derived by a person skilled in the art without going beyond the scope of the invention.

The invention claimed is:

1. A burner assembly comprising:

a combustion chamber, multiple mixing ducts opening into the combustion chamber and in which during normal operation introduced combustion air and introduced fuel are mixed, wherein the multiple mixing ducts are formed by mixing tubes which extend axially through an annular space which is defined between a tubular external wall, a tubular internal wall arranged so that is spaced apart radially from the tubular external wall, an annular end plate arranged upstream, and an annular end plate arranged downstream and comprising an upstream face and a downstream face that faces the combustion chamber, wherein the annular end plate arranged upstream and the annular end plate arranged downstream are provided with through openings which receive and/or continue the mixing tubes, each annular end plate comprising both a radially inward circumferential edge and a radially outward circumferential edge, both extending in a direction of the annular space, axial bores that extend axially through at least one circumferential edge of the radially inward circumferential edge and the radially outward circumferential edge of the annular end plate arranged downstream, each axial bore of the axial bores comprising an inlet at the upstream face, and at least one opening disposed between the upstream face and the downstream face and branching off from a respective axial bore of the axial bores for the removal of cooling air laterally relative to the respective bore and through the at least one circumferential edge.

2. The burner assembly as claimed in claim 1, wherein the at least one opening opens into a chamber which is open toward the annular space.

3. The burner assembly as claimed in claim 2, wherein multiple axial bores of the axial bores open into the chamber.

4. The burner assembly as claimed in claim 1, wherein the axial bores are arranged in both the radially outward circumferential edge and the radially inward circumferential edge of the annular end plate arranged downstream.

5. The burner assembly as claimed in claim 1, wherein the at least one opening opens into an elongated depression, wherein the elongated depression extends in an upstream direction from the combustion chamber along the at least one circumferential edge of the annular end plate arranged downstream.

6. The burner assembly as claimed in claim 5, wherein the elongated depression is arranged in the radially inward circumferential edge.

7. The burner assembly as claimed in claim 5, wherein a length of the elongated depression is less than a height of the at least one circumferential edge.

8. The burner assembly as claimed in claim 5, wherein a base of the elongated depression comprises a cross-sectional profile which is a circle, an oval, or an ellipse.

9. The burner assembly as claimed in claim 5, wherein the at least one opening of two axial bores open into the elongated depression in such a way that opposite sides of the elongated depression are coolable by impingement cooling.

10. The burner assembly as claimed in claim 5, wherein further openings are arranged in the elongated depression in the direction of the annular space.

11. The burner assembly as claimed in claim 1, wherein the annular end plate arranged downstream comprises an upstream wall comprising the upstream face, a downstream wall comprising the downstream face, and a hollow volume therebetween, and wherein the at least one opening provides fluid communication between the respective axial bore and the hollow volume.

12. A burner assembly comprising:

a combustion chamber, multiple mixing ducts opening into the combustion chamber and in which during normal operation introduced combustion air and introduced fuel are mixed, wherein the multiple mixing ducts are formed by mixing tubes which extend axially through an annular space which is defined between a tubular external wall, a tubular internal wall arranged so that is spaced apart radially from the tubular external wall, an annular end plate arranged upstream, and an annular end plate arranged downstream, wherein the annular end plate arranged upstream and the annular end plate arranged downstream are provided with through openings which receive and/or continue the mixing tubes and comprise, both radially inward and radially outward, a circumferential edge which extends in a direction of the annular space, axial bores that extend axially through at least one circumferential edge of the radially inward circumferential edge and the radially outward circumferential edge of the annular end plate arranged downstream, and at least one opening branching off from a respective axial bore of the axial bores for the removal of cooling air, wherein the at least one opening opens into an elongated depression, wherein the elongated depression extends in an upstream direction from the combustion chamber along the circumferential edge of the annular end plate arranged downstream.

* * * * *